United States Patent [19]

Parkinson

[11] 4,058,336

[45] Nov. 15, 1977

[54] DEVICES FOR PICKING UP BALLS

[76] Inventor: Sydney Parkinson, 8 Pine Grove, Ashton-on-Mersey, Sale, Cheshire, England

[21] Appl. No.: 679,762

[22] Filed: Apr. 23, 1976

[51] Int. Cl.[2] ..... A47F 13/06

[52] U.S. Cl. ..... 294/19 A

[58] Field of Search ..... 294/19 A, 1 R, 50.6, 294/50.7, 50.8, 50.9, 55, 99; 273/32 F, 32 R, 32 D, 32 B, 162 E; 56/328 R; 85/8.8

[56] References Cited

U.S. PATENT DOCUMENTS

| | | | |
|---|---|---|---|
| 1,937,828 | 12/1933 | MacDonald | 294/19 A |
| 2,962,321 | 11/1960 | Fowler et al. | 294/19 A |
| 3,186,593 | 6/1965 | Miotke | 294/19 A |
| 3,508,772 | 4/1970 | Stahl et al. | 85/8.8 |
| 3,558,170 | 1/1971 | Stanworth | 294/19 A |

*Primary Examiner*—James B. Marbert

*Attorney, Agent, or Firm*—Ross, Ross & Flavin

[57] ABSTRACT

A device for picking up balls, such as golf balls, is in the form of a tube, preferably of a translucent plastics material, having at one end a ball retainer in the form of a pawl which is loaded resiliently towards an operative position projecting inwardly of the tube and which can pivot, against its loading, in a direction away from the said one and, into an inoperative position not obstructing the interior of the tube, so that a ball can be picked up by pushing said one end over the ball which deflects the pawl as it enters the tube, the pawl then returning to its operative position to retain the ball in the tube.

8 Claims, 4 Drawing Figures

DEVICES FOR PICKING UP BALLS

ENVIRONMENT OF THE INVENTION

This invention concerns a device for picking up balls, more particularly but not exclusively golf balls.

BACKGROUND OF THE INVENTION AND BRIEF DESCRIPTION OF PRIOR ART

In practicing ball games, such as golf, it is commonplace to use a considerable number of balls, for example for performing a succession of practice strokes. These balls must therefore subsequently be retrieved, and it has already been proposed to provide a device for picking them up in the form of a tube of plastics material which is substantially circular in cross-section, adapted to the size of the balls it is intended to be used with, over the majority of its length but is of non-circular section at least at one end, so that a ball can enter the tube by such end only by deformation of the material of the tube. In order to pick up a ball resting on the ground, the user holds the device with its non-circular end downwards and places such end on the ball. Thereupon, downward pressure on the tube forces the non-circular end over the ball which is retained in place by the resilience of the material of the tube. This operation is repeated for successive balls, entry of each of which serves to cause the preceding balls to rise within the tube.

For such known devices to be of practical utility they have to be of an appropriate length such that they will hold a useful number of balls and can be used without the need to bend down, and usually, therefore, for golfing use they are of such a length as to be able to hold at least twenty golf balls. Twenty golf balls have a considerable weight and accordingly the non-circular end of the tube has to retain the lowermost ball with sufficient force to prevent the weight of some twenty (or more) balls thereabove causing the balls to drop out of the tube. Therefore the shape of the non-circular end of the tube has to be such as to require substantial force to be overcome for each ball to enter the tube. As a consequence the device is not easy to use and in fact frequently women find it impossible to use.

An object of this invention is to provide a ball pick-up device wherein this difficulty is obviated.

BRIEF DESCRIPTION OF THE INVENTION

With this object in view, the present invention provides a device or picking up balls comprising a tube having, at one end, a ball retainer arrangement comprising a pawl tooth resiliently loaded towards an operative rest position projecting inwards of the tube and pivotable in a direction away from said one end to an inoperative position not obstructing the interior of the tube.

With such an arrangement, upon the tube being pushed over a ball by said one end the pawl tooth is deflected towards the inoperative position by the ball to permit the latter to enter the tube. Once the ball has so entered, and the pawl tooth has returned to its operative rest position, the pawl tooth prevents the ball from dropping out of the tube since the weight of the ball simply retains the pawl tooth in the operative rest position projecting inwards of the tube and leaving an insufficient gap for the ball to pass.

For enabling balls to be removed from the tube the other end of the latter may be provided with a removable cap. Alternatively, it may be fitted with a fixed or non-removable cap, in which case means, such as a knob disposed externally of the tube, may be provided for permitting the pawl to be pivoted manually into the inoperative position against the resilient loading.

The knob may be connected with the pawl tooth by way of a neck providing a recess for location therein of a resilient band which extends circumferentially around the said one end of the tube and loads the pawl tooth into the operative position.

The resilient band is conveniently located in a circumferential groove around the said one end of the tube.

The pawl tooth may advantageously be located in position by being mounted upon a metal ring located in a respective groove around the tube.

The said one end of the tube may be formed with a ledge or step diametrically opposite to the pawl tooth, so that the lowermost ball in the tube will rest on and be retained by the pawl tooth and the ledge or step.

In a preferred embodiment, the pawl, as well as the resilient band and the metal ring and the ledge or step, where present, are all provided on a separately-formed end section of the tube.

Markings are conveniently provided longitudinally of the tube, e.g. on a tape or band extending therealong, to provide a visual indication of the number of balls (if any) contained therein.

THE DRAWING

In order that the invention may be understood, it will be described further, by way of example, with reference to a preferred embodiment thereof as illustrated in the accompanying drawing, the following description being illustrative, and not restrictive, of the scope of the invention.

DETAILED DESCRIPTION OF THE EMBODIMENT SHOWN IN THE DRAWINGS

Figure 1:
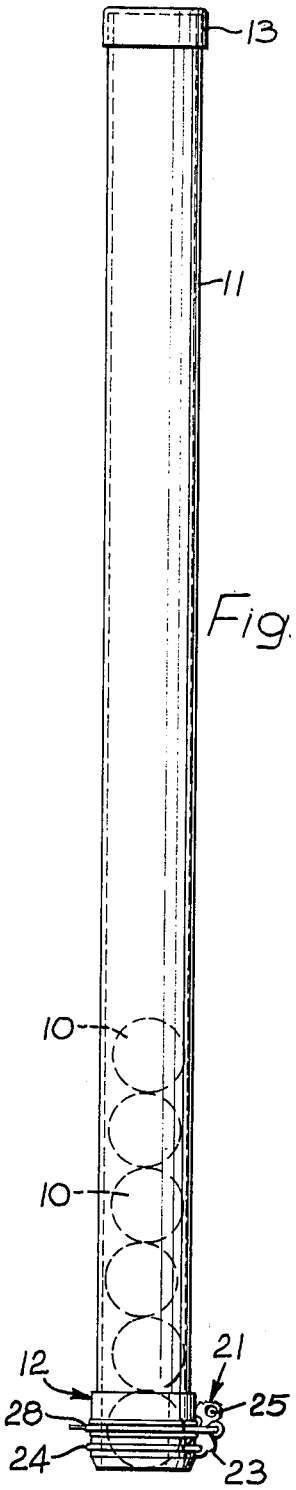
FIG. 1 is an elevation of the said preferred embodiment of the device of the invention.

The illustrative preferred embodiment of the device of the invention, which is for picking up golf balls 10, is in the form of a tube which comprises a main body section 11 of translucent plastics tubing of diameter slightly greater than the outside diameter of a standard golf ball 10. On the end of this main body section 11 is secured a separately-formed end section 12 of the tube and on the other end thereof an end closure cap 13 is secured to the main body section 11, e.g. by an appropriate adhesive.

Internally, the end section 12 of the tube is stepped twice to provide a wide-diameter portion 14, into which the main body section 11 fits, followed by an intermediate portion 15 whose cross-section correspond substantially to the inner diameter of the main body section 11 of the tube. Such intermediate portion 15 joins by a circumferential ledge or step 16 with a narrow-diameter portion 17 through which a golf ball 10 will just pass.

Externally, the end section has a first circumferential groove 18 whose location is substantially level with the middle of the intermediate portion 15, as well as a second circumferential groove 19 which is just below the level of the ledge or step 16.

Figure 2:
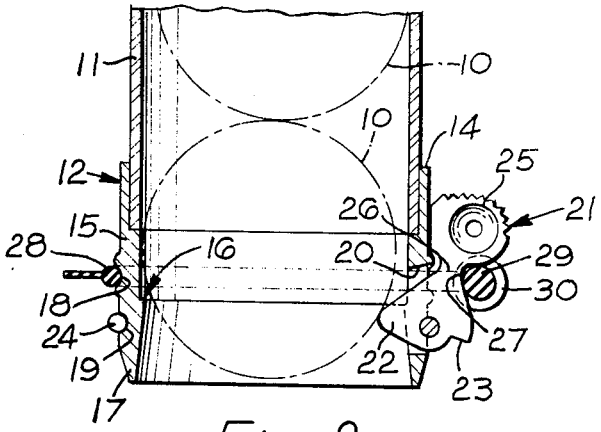
FIG. 2 is a sectional elevation, to an enlarged scale, of the bottom of the device shown in FIG. 1.
Figure 3:
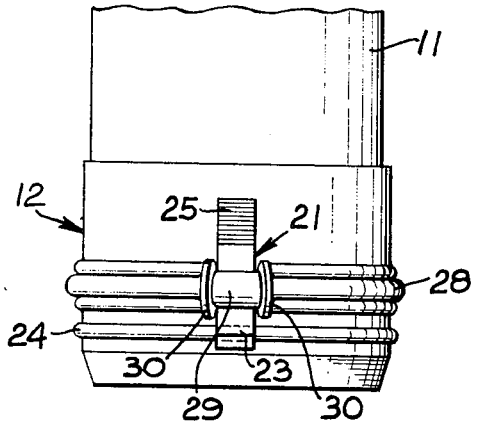
FIG. 3 is a side view, taken as indicated by the arrow III in FIG. 2.

A short slot-like opening 20 is provided through the wall of the end section 12, this extending parallel to the axis of the tube and accommodating a pawl member 21 which is of a configuration to provide a first quadrant-like pawl tooth 22 protruding through the opening 20 and into the interior of the tube, and a stop 23 projecting away from the tube (see FIG. 2) and forming a stop to limit the possible pivotal movement of the pawl member 21 by abutting against the outer surface of said end section 12.

The pawl member 21 is retained in position by a metal ring 24, formed of round-sectioned spring metal wire, which extends through a hole in the pawl member 21 and is located in the second groove 19 around the end section 11 of the tube.

The pawl member 21 is formed with a knob 25 which connects therewith by a narrow neck 26 defining a niche or recess 27 which is approximately level with the first groove 18 around the end section 11 of the tube. A tough plastics ring 28 extends around the end section 11 in such first groove 18 and locates by a thickened portion 29 between collars 30, in the niche or recess 27 thereby to load the pawl member 21 resiliently into its operative position shown in FIG. 2 wherein its tooth 22 projects inwards of the tube.

Figure 4:
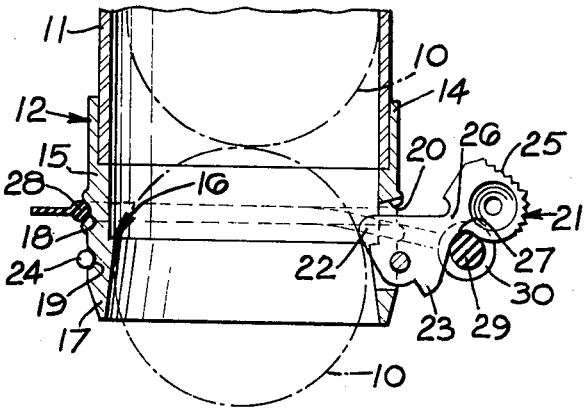
FIG. 4 is a sectional elevation similar to FIG. 2, but showing the device being used to pick up a ball.

With such arrangement, therefore, pivotal movement of the pawl 21 from its operative position can only occur in a direction such that its tooth swings away from the adjacent open end of the tube. Thus, when the device is pushed over a ball 10 as shown in FIG. 4, such ball 10 is able to deflect the pawl's tooth 22 and enter the tube whereafter the pawl returns to its operative position shown in FIG. 2 and is effective to retain the ball 10. The weight of such ball 10 on the pawl's tooth 22 loads the pawl 21 into its operative position preventing the ball 10 from falling out of the tube, and the ball 10 is retained securely regardless of how many further balls 10 may be present in the tube to load the pawl 21.

When it is desired to remove balls 10 from the tube, it is only necessary to pivot the pawl 21, against the action of the resilient ring 29 and the weight of any balls 10 in the tube, into its inoperative position clear of the interior of the tube, so that the balls 10 (or a desired number thereof) are permitted to roll out of the tube.

The invention is not confined to the precise details of the foregoing example, and variations may be made thereto. Thus, an indicator tape (not shown) bearing markings to indicate visually the number of balls 10 contained within the tube may be adhered along the tube, or similar markings may be moulded thereon.

The pawl member 21 need not be provided with a knob 25 permitting manual pivoting thereof if the end closure cap 13 on the other end of the tube is detachable to permit removal of balls from the tube.

If desired, the end section 12 of the tube may be tapered as shown to enable it to penetrate the ground when the device is being used to pick up a ball, thereby ensuring, particularly where the ground is soft, that the ball enters properly into the tube and passes the pawl's tooth 22 so as to be positively retained thereby.

I claim:

1. A device for picking up balls comprising: a tube having, at one end, a ball retainer arrangement including a pawl tooth resiliently loaded towards an operative rest position projecting inwardly of the tube and pivotable in a direction away from the said one end to an inoperative position free of the tube interior, the ball retainer arrangement including a knob means disposed externally of the tube for permitting the pawl tooth to be pivoted manually into the inoperative position against its resilient loading, the knob means being connected with the pawl tooth by way of a neck providing a recess for location therein of a resilient band extending circumferentially around the said one end of the tube for loading the pawl tooth into the operative position.

2. In the device as set forth in claim 1, the resilient band being located in a circumferential groove around the said one end of the tube.

3. In the device as set forth in claim 2 with markings on the tube longitudinally thereof which is translucent for providing a visual indication of the number of balls contained therein.

4. A device as set forth in claim 1, the pawl tooth being located in position by a mounting upon a metal ring located in a respective groove around the tube.

5. In the device as set forth in claim 1, the said one end of the tube being formed with a ledge diametrically opposite the pawl tooth with a lowermost ball in the tube resting on and being retained by the pawl and ledge.

6. In the device as set forth in claim 1, with a resilient band being disposed circumferentially of the tube for loading the pawl into operative position.

7. In the device as set forth in claim 1, with a ledge being provided on the tube and a lowermost ball in the tube being retained between the pawl and the ledge.

8. A ball handling device for retrieving balls and storing same and selectively dispensing same comprising in combination:

a retaining means having an interior well for receiving the balls and having a lower opening of a size through which balls may freely pass to and from the well, a pawl including a tooth and a knob with a neck therebetween and with the tooth being pivotally mounted relative to the retaining means and swingable between an operative ball-obstructing position inwardly of the well for supporting a ball resting upwardly of and on the tooth and an inoperative non-ball-obstructing position outwardly of the well for allowing passage of balls therepast in upward storing and downward dispensing directions, loading means circumscribing the retaining means and the neck of the pawl for resiliently biasing the tooth into a normal operative ball-obstructing position, with the tooth of the pawl being swingable upwardly into non-ball-obstructing position responsively to the upward pressure of a to-be-retrieved ball as the retaining means is brought down over the ball for moving the ball through the lower opening of and upwardly into the well sufficiently for the release of the pawl returnably to operative ball-obstructing position, and with the pawl knob being manually depressible against the resilient bias of the loading means for the swinging of the pawl tooth into non-ball-obstructing position and the dispensing of the ball outwardly of the well.

* * * * *